United States Patent [19]

Mesenich

[11] Patent Number: 5,044,563

[45] Date of Patent: Sep. 3, 1991

[54] ELECTROMAGNETIC FUEL INJECTOR WITH DIAPHRAGM SPRING

[75] Inventor: Gerhard Mesenich, Bochum, Fed. Rep. of Germany

[73] Assignee: Siemens Automotive L. P., Auburn Hills, Mich.

[21] Appl. No.: 419,489

[22] Filed: Oct. 10, 1989

[30] Foreign Application Priority Data

Oct. 10, 1988 [DE] Fed. Rep. of Germany ..... 3834444

[51] Int. Cl.[5] ..... B05B 1/30

[52] U.S. Cl. ..... 239/585; 251/129.18

[58] Field of Search ..... 251/129.17, 129.15, 251/129.18, 129.22; 239/585, 606

[56] References Cited

U.S. PATENT DOCUMENTS

| | | | |
|---|---|---|---|
| 2,881,980 | 4/1959 | Beck et al. | 239/562 |
| 3,247,833 | 4/1966 | Beddoes et al. | 123/32 |
| 3,567,135 | 3/1971 | Gebert | 239/585 |
| 4,010,390 | 3/1977 | Stampfli | 310/30 |
| 4,454,990 | 6/1984 | Lewis | 239/585 |
| 4,475,690 | 10/1984 | Hascher-Reichl et al. | 239/585 |
| 4,527,744 | 7/1985 | Hafner et al. | 239/585 |
| 4,535,816 | 8/1985 | Feder et al. | 137/625.65 |
| 4,552,311 | 11/1985 | Casey | 239/551 X |
| 4,555,060 | 11/1985 | Knapp et al. | 239/585 |
| 4,585,176 | 4/1986 | Kubach et al. | 239/585 |
| 4,662,567 | 5/1987 | Knapp | 239/585 |
| 4,795,098 | 1/1989 | Kirchner et al. | 239/585 |
| 4,951,878 | 9/1990 | Casey et al. | 239/585 C |

FOREIGN PATENT DOCUMENTS

| | | | |
|---|---|---|---|
| 505974 | 8/1930 | Fed. Rep. of Germany . | |
| 1263396 | 3/1968 | Fed. Rep. of Germany . | |
| 2245255 | 4/1974 | Fed. Rep. of Germany . | |
| 2359999 | 6/1975 | Fed. Rep. of Germany . | |
| 3110251 | 7/1982 | Fed. Rep. of Germany . | |
| 3320610 | 12/1984 | Fed. Rep. of Germany . | |
| 3704541 | 9/1988 | Fed. Rep. of Germany . | |
| 304749 | 3/1989 | Fed. Rep. of Germany | 239/585 |
| 107870 | 6/1983 | Japan | 239/585 |
| 1426655 | 3/1976 | United Kingdom . | |
| 2175452 | 5/1985 | United Kingdom . | |

*Primary Examiner*—Andres Kashnikow
*Assistant Examiner*—Kevin Weldon
*Attorney, Agent, or Firm*—George L. Boller; Russel C. Wells

[57] ABSTRACT

An extremely fast electromagnetic fuel injector in miniature form which is intended predominantly for fuel injection into the suction pipe of combustion engines. The device features an armature of extremely low mass which is guided only by a diaphragm spring. The injector is mounted in a plastic valve carrier. In addition, a procedure for dynamic calibration is proposed where the magnetic resistivity of the magnetic circuit is varied.

11 Claims, 4 Drawing Sheets

ELECTROMAGNETIC FUEL INJECTOR WITH DIAPHRAGM SPRING

BACKGROUND OF THE INVENTION

The subject of the invention is a miniature electromagnetic fuel injector intended for the bulk injection of fuel into the suction pipe of combustion motors. The fuel pressure preferably is in the order of 1–4 bar.

There exist a large number of electromagnetic injection valves for the purpose of fuel injection into the suction pipe of combustion motors. A common characteristic for these injection valves is a desire for high dosage accuracy. Such high dosage accuracies can be achieved only with very short opening and closing times. Opening and closing times for the best known valves are 0.5–1.5 ms, depending somewhat on the impedance of the electromagnet. The required short closing times should be achieved with the lowest possible input of electrical energy.

State of the art valves typically are of axially symmetric design. This armature of such valves is located at the central axis of the valve and acts on a valve obturator which in most cases is of needle-type design. A needle-type valve obturator is a requirement in order to allow for a slender design in the mounting region of the injector. The slender design for the injector is desirable so that the combustion air can pass through the injector region with the least amount of interference. The external diameter of such valves is typically 20–25 mm. The moving mass of needle valves is typically from 2–4 g. In order to prevent objectionable armature bounce, and in order to achieve short floating times, the conventional injectors feature only very small stroke heights. The stroke height of modern injector valves are in the range of 0.05–0.1 mm. In order to prevent unacceptable variations in flow-through characteristics, the state of the art valves require extremely tight machining tolerances. In addition, state of the art valves require a difficult calibration procedure.

SUMMARY OF THE INVENTION

It is the objective of this invention to define a miniature fuel injector which is capable of very fast floating times, at low armature bounce and low electric energy consumption, and allows for lower tolerance requirements in manufacture.

The fuel injector according to the instant invention features a very small armature of small diameter and exceptionally low mass, in general of the order of 0.1–0.2 g. The low armature mass allows for fast and chatter-free floating movements, even for larger stroke heights. The fuel injector allows for very small overall dimensions where the external diameter in the magnetic circuit area is only of the order of 8–12 mm. The external diameter of the fuel injector is thus only insignificantly larger than the frontal diameter of state of the art needle valves. Because of these reduced dimensions it is possible to dispense with the otherwise required valve needle, without having to pay the penalty of larger valve dimensions in the valve seat area. It is for this reason that the fuel injector according to this invention can be readily adapted to a variety of installation conditions. In addition, the fuel injector according to this invention, in contrast to state of the art designs, features an armature with diaphragm guidance. Diaphragm guidance allows for a further considerable reduction of the overall valve dimensions.

DETAILED DESCRIPTION OF THE PREFERRED EMBODIMENTS OF THE INVENTION

Figure 1:
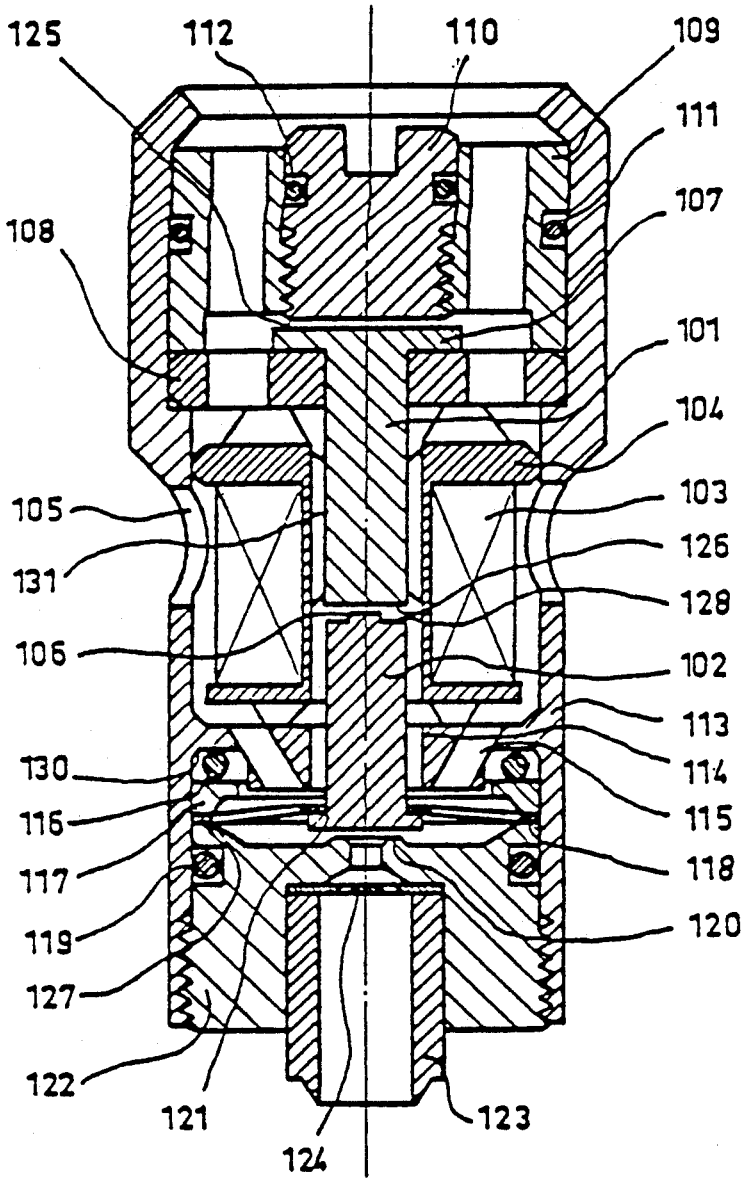

A preferred design example of the instant fuel injector is shown in FIG. 1. It will be described in detail in the following:

The valve according to FIG. 1 features a cylindrical armature 102, with the following dimensions: length 5 mm, external diameter 2.5 mm, mass 0.12 g. The magnetic circuit of the valve consists of armature 102, magnet pole 101, calibration plug 110, housing cover 109, and valve housing 113. These segments of the magnetic circuit consist of low retentivity material. Magnet pole 101 is solidly connected to a non-magnetizable flange 108. Flange 108 is secured by housing cover 109. Housing cover 109 is beaded to magnet housing 113. Magnetic coil 103 surrounds pole 101 and armature 102. The working gap of the magnetic circuit is arranged to be about in the middle of the coil. Coil 103 is located on coil core 104. Connection wires and contact plug, which are always necessary, are not represented. Air gap 114 of armature 102 is located directly in valve housing 113. The diameter of air gap 114 should be approximately 0.4 mm larger than the armature diameter. As the valve is energized, armature 102 is pulled against the flat pole face 126 of magnet pole 101. The area of the pole is approximately 3 $mm^2$. The upper end of armature 102 is provided with a circular stop 106, surrounded by a hydraulic bypass gap 128. The diameter of the stop is about 1 mm. The undercutting of the by-pass gap should be about 5 micrometers. By means of bypass gap 128 an effective cushioning effect of the stroke movement is achieved. In addition, the hydraulic gap-forces favor centering of the armature. In most cases, hardening of the stopping faces is therefore not required, due to the effect of the hydraulic dampening of the stroke movement. Bypass gap 128 is preferably produced by indenting. The lower end of armature 102 closes valve seat 120. The diameter of the valve seat is preferably 1–2 mm, compared to the valve seat diameters of state of the art valve seats, effectively about only one half the usual dimension. Given low fuel pressure of only about 1 bar, larger seat diameters of up to 3 mm may, however, be also appropriate. Armature stroke is usually 0.1–0.2 mm. Given this approximately doubled stroke height, compared to state of the art valves, allowances can be made in the permissible tolerances. The larger stroke height is made possible by the extremely low movable mass of the valve, without being concerned about unacceptable armature bounce. In addition the small movable mass of the valve makes it possible to use relatively thin obturators made of elastic plastic material. Obturators of this type are known as such, but are usually quickly destroyed in conventional state of the art valves, because of the high kinetic energy of the armature. A plastic valve obturator of this type should have a thickness of a few tenths of a millimeter in the valve seat region for valves according to the instant invention. The width of valve seat 120 should be between 0.1–0.2 mm. In addition, it is useful to arrange for additional bypass gaps in the valve seat region in order to provide for parallel hydraulic guidance of the armature. Bypass gaps of this type ate described in a parallel, separate application. Fuel supply is via the drilled side openings 105 which are provided in valve housing 113. From there the fuel passes via bypass gap 114 and drilled holes 115 to valve seat 120. Alternatively, fuel may also be supplied through housing cover 109 and flange 108. This then allows for especially slender valve designs. In addition, coil core 104 is axially grooved in the region of pole 101 to guarantee satisfactory fuel flow characteristics around armature 102. This prevents the collection of vapour bubbles in the working gap region which might otherwise impair the stability of armature movements.

Armature 102 features a small collar 121 at its lower end on which diaphragm spring 118 rests. Diaphragm spring 118 produces the reset force and provides lateral guidance to the armature. Diaphragm spring 118 is provided with perforations, allowing the fuel to pass through to valve seat 120. At the outer perimeter, diaphragm spring 118 rests on collar 127 of the lower closure plug 122. Diaphragm spring ]18 is forced onto collar 122 by means of thrust collar 117. The force is generated by an elastic collar 116 which is located in housing groove 130. Closure plug 122 is threaded into valve housing 113. The thread connection allows for setting the stroke height. The closure plug is sealed against housing 113 by means of packing gasket 110. The closure plug contains injector plate 124, which is held fixed by the pressure fitted spray diffuser 123.

Diaphragm spring 118 may have relatively stiff spring characteristics where the force provided by the spring towards the end of the armature lift may considerably exceed that provided at the beginning of the stroke. The spring force near the end of the armature stroke should be chosen to be about 50% of the maximum magnetic force. Such stiff spring characteristics improve the efficiency of the valve, as has been explained in detail by applicant during a previous application (P 33 14 899). Diaphragm spring 118 rests directly on lower closure plug 122: thus a change in the depth of threading in the closure plug does not affect the spring power. By these arrangements it becomes possible to change stroke height and initial spring force independently. The thickness of the diaphragm spring is approximately 0.05–0.1 mm. The diaphragm spring is provided with perforations to achieve an adequately low spring stiffness, and to allow for passage of the fuel. These perforations should be arranged in such a manner that several radial or tangential arms result, they may also be in spiral form. Suitable designs for such perforated diaphragm springs can be found in the respective patent literature. In addition, it is useful not to clamp the diaphragm spring too tightly. Sideways slippage for the spring should be possible to a minor degree. For very small diaphragm springs which have been clamped too tightly, the long term stability of the spring characteristics can be disadvantageously affected, and the springiness can be reduced. In line with the present invention, clamping of the diaphragm spring 118 is obtained with the aid of thrust collar 117 and elastic collar 116. Ring 116 preferably is one of the commercial gasket rings.

To actuate the valve, according to the principles of the invention, magnetic circuit of especially small dimensions is used, characterized also by the very small area 126 of the pole face. The magnetic efficiency of a magnetic circuit with a very small effective pole area is always less than that of magnetic circuits of conventional dimensions. Nevertheless, in order to achieve a useful degree of magnetic efficiency, it is a first requirement to locate the working gap inside the magnetic coil. The most advantageous location from the point of view of magnet technology is thus to locate the working gap about in the center of the magnetic coil. Because of the relatively low degree of effectiveness associated with small magnetic circuits, we surmise that heretofore experts did not seriously consider them for applications in electromagnetic injection valves. Investigations of the applicant have, however, demonstrated that, with miniature magnetic circuits according to this invention, and despite the reduced electromagnetic efficiency over the state of the art valves, improved dynamic characteristics can indeed be obtained. The overall improvement in dynamic behaviour is caused by the extremely small movable mass, by the reduced inductance which is a consequence of the smaller pole area, also by the magnetically more favorable location of the working gap, the frictionless armature guidance, and the total reduced force level.

The number of turns of magnet coil 103 is twice that of state of the art injectors. The number of turns depends strongly on the design of the trigger circuitry employed and usually amounts to 400–1000 turns. Despite the high number of turns, and based on the small coil diameter, the overall dimensions of the magnetic coil can be kept small, without resulting in unacceptable heating or unacceptably large electric resistance.

Calibration of the injector valve is done in several distinct steps. At first, the starting spring force which acts on armature 102 is set. Several approaches are possible: diaphragm spring 118 may be shaped in suitable fixtures, adapter rings may be inserted under the outer or inner collar of the diaphragm spring, or the thickness of the collar 121 may be varied. Then the static fuel flow parameter is set, or respectively, the armature stroke, by positioning lower threaded closure plug 122.

As a additional special feature, the diaphragm injector features an additional air gap 125, which is located in the magnetic circuit and serves for dynamic calibration of the valve. A change in air gap 125 results in a change in magnetic resistivity of the magnetic circuit. Enlarging the air gap 125 causes a delay in pick-up time and a shortening of release time. In this manner the dynamic flow-through characteristics can be calibrated by setting air gap 125. Air gap 125 is set by positioning calibration screw 110 to the desired distance between pole 101 and plug 110. The area of air gap 125 is enlarged, with respect to pole face 126, by means of collar 107. This reduces the sensitivity of the calibration step.

Calibrating the dynamic characteristics by means of air gap 125 results in several principal advantages. To start with, by means of this additional calibration feature it is possible to allow for considerably larger tolerances in the diaphragm spring characteristics. It is difficult to produce such springs with narrow tolerances. Further, additional air gap 125 results in an approximately balanced distribution of the individual air gaps of the magnetic circuit with respect to the course of the magnetic field lines. This decreases the stray field of the magnetic circuit and improves the electromagnetic effectiveness.

Figure 2:
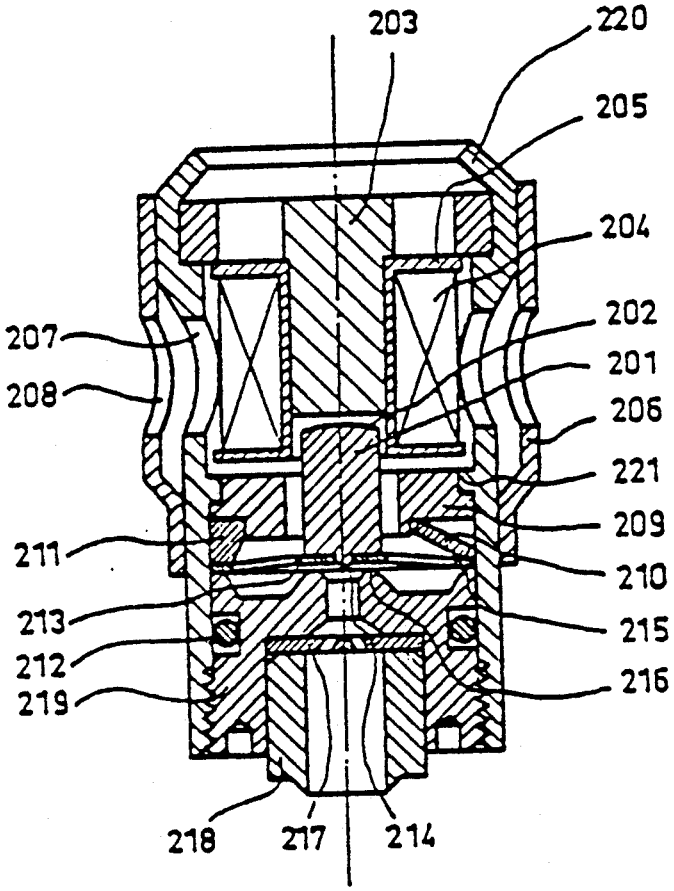

Another suitable design according to the instant invention is shown in FIG. 2. The special feature in this case is that a hardened diaphragm spring serves directly as the valve obturator. The valve features two external air gaps for calibration purposes. Dynamic calibration in this design is especially simple and is done by means of an external movable sleeve. Details pertaining to the design features in FIG. 2 follow:

The magnetic circuit of the injector valve consists of armature 201, magnet pole 203, external sleeve 206 and side-pole 209. The valve housing 220 consists of non-magnetizable material. Between externally fitted sleeve 206 and pole 203, and also between sleeve 206 and side-pole 209, two additional permanent air gaps are located. The magnetic resistivity of these air gaps can be varied by axially displacing sleeve 206. By means of this displacement the valve can be dynamically calibrated. Sleeves 206 should be provided with a lateral slot to allow for a simple way to establish a clamped connection. Magnet pole 203 is clamped into housing 220 by means of a bead. Side-pole 209 is inserted into the housing from below and rests in the housing on the inward directed collar 221. Side-pole 209 is forced against collar 221 either by a spring washer 210 or by means of thrust collar 211 which consists of elastic plastic material. Coil core 205 is fitted and joined to magnet pole 203, preferably by means of clamping. Magnet coil 204 is wound onto coil core 205. Housing 220 and sleeve 206 are provided with drilled side inlets 207 and 208 serving as the entry ports for fuel. Armature 201 features a ball-type surface 202, which, in the energized state of the armature, closes against magnet pole 203. The advantage of the ball-type surface 202 is found in the fact that for a possibly canted position of armature 201, hydraulic damping in the working gap is only minimally affected. Additionally, the ball-type surface largely prevents hydraulic sticking. Armature 201 is solidly joined to diaphragm spring 213. The connection of armature 201 and diaphragm spring 213 is made preferably by adhesive joining or soft soldering, but can, for instance, also be based on a riveted joint. To facilitate joining armature 201 to diaphragm spring 213, the armature is provided with a centering collar 214. Diaphragm spring 213 is perforated for the reasons previously stated. For the unenergized state, diaphragm spring 213 seats in valve seat 216. The outer perimeter of diaphragm spring 213 rests on collar 215. Collar 215 and valve seat 216 are located in a common plane of closure plug 219. The flat positioning of diaphragm spring 213 makes for a simple method to arrive at the desired stiff spring characteristics. This automatically results, in case of a flat diaphragm spring, in the desired negligibly small initial spring force for the case of a non-energized armature. Additionally, the flat positioning of the diaphragm valve makes it possible to avoid manufacturing problems with a series of differentiated precision tolerances. Closure plug 219 holds the pressure fitted spray diffuser 218. Plug 219 is sealed against housing 220 with a gasket 212. Plug 219 is threaded and can be used to set the armature stroke.

The fuel injector can be mounted in a plastic valve support device in such a manner that only the bottom end of the injector juts out. By means of the plastic valve support, the overall dimensions of the injector, according to the instant invention, can be made similar to those of state of the art items. The injector can then be used for direct replacement of existing series products. In addition, the valve support can provide connecting pieces for fuel supply. Furthermore, the valve support device protects the injector mechanically and facilitates handling of the very small valve. With the aid of the valve support, a composite structure is devised which is characterized by the fact that the magnetic circuit of the injector is located in the foremost part of the composite injector. In general, the device is provided with a gasket located in a groove at the lower end of valve housing 113, or, alternatively, an additional collar is provided on closure plug 122 where the sealing gasket can be placed. The injector is slipped into the valve support from the bottom. Fastening of the injector in the support device can be, for instance, by means of ultrasonic welding or by pressure-fitting. A special advantage of the mounting of the injector in an additional support device results from the fact that sealing of the individual parts of the injector itself is not required. Sealing is then arrived at through the valve support which surrounds the injector. Gaskets 111 and 112, as shown in FIG. 1, can then be omitted. Seals inside the injector itself frequently result in leakage problems during manufacture of the state of the art devices, thus the complete unit becoming unusable.

Figure 3:
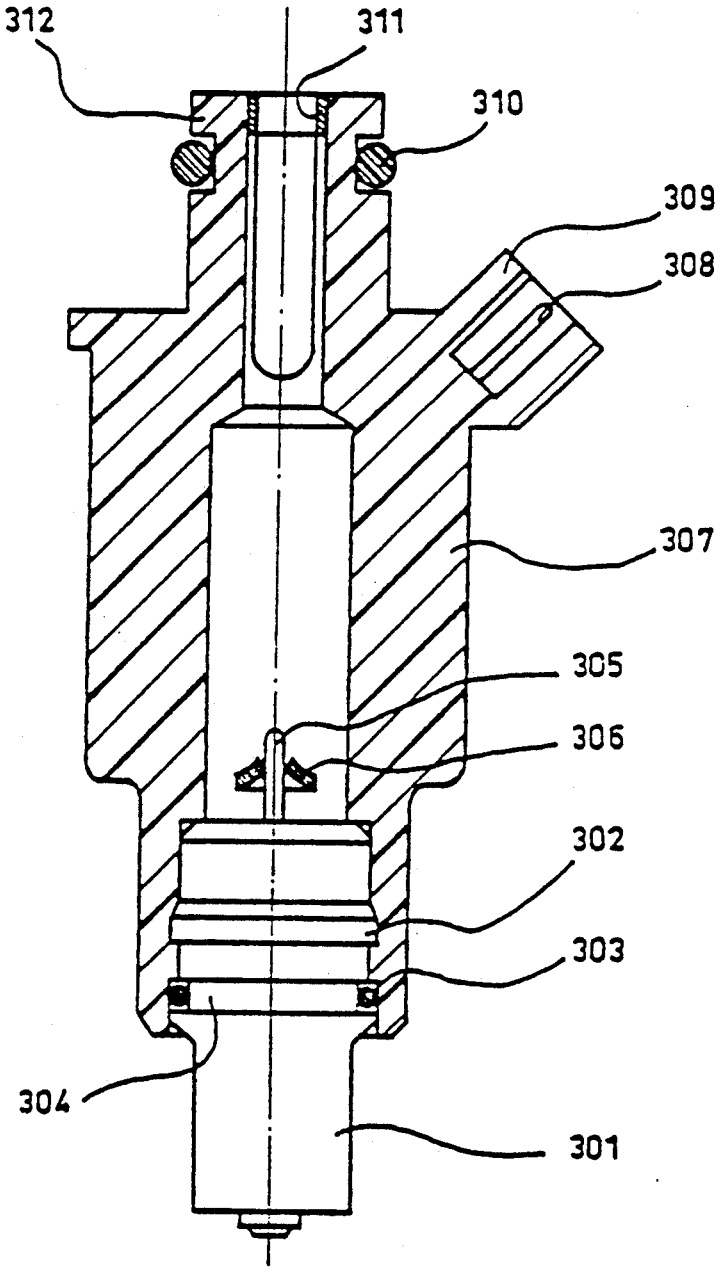

A composite valve of this type is shown in FIG. 3. Injector valve 301 is inserted into valve carrier 307 from below. Injector valve 301 is provided with mounting collar 302 and a gasket 303. Gasket 303 is installed in groove 304. Contact pin 305 of injector valve 301 is inserted into terminal connector 306. Fuel supply is via the upper housing cover of injector valve 301. Feed nozzle 312 of valve carrier 307 is provided with gasket 310. Fuel filter 311 is internally mounted in feed nozzle 312. Valve carrier 307 also contains connecting plug 309, inside which contact pin 308 is located. Contact pin 308 is connected with terminal connector 306 by means of contact elements which are embedded in the plastic material of valve carrier 307.

Figure 4:
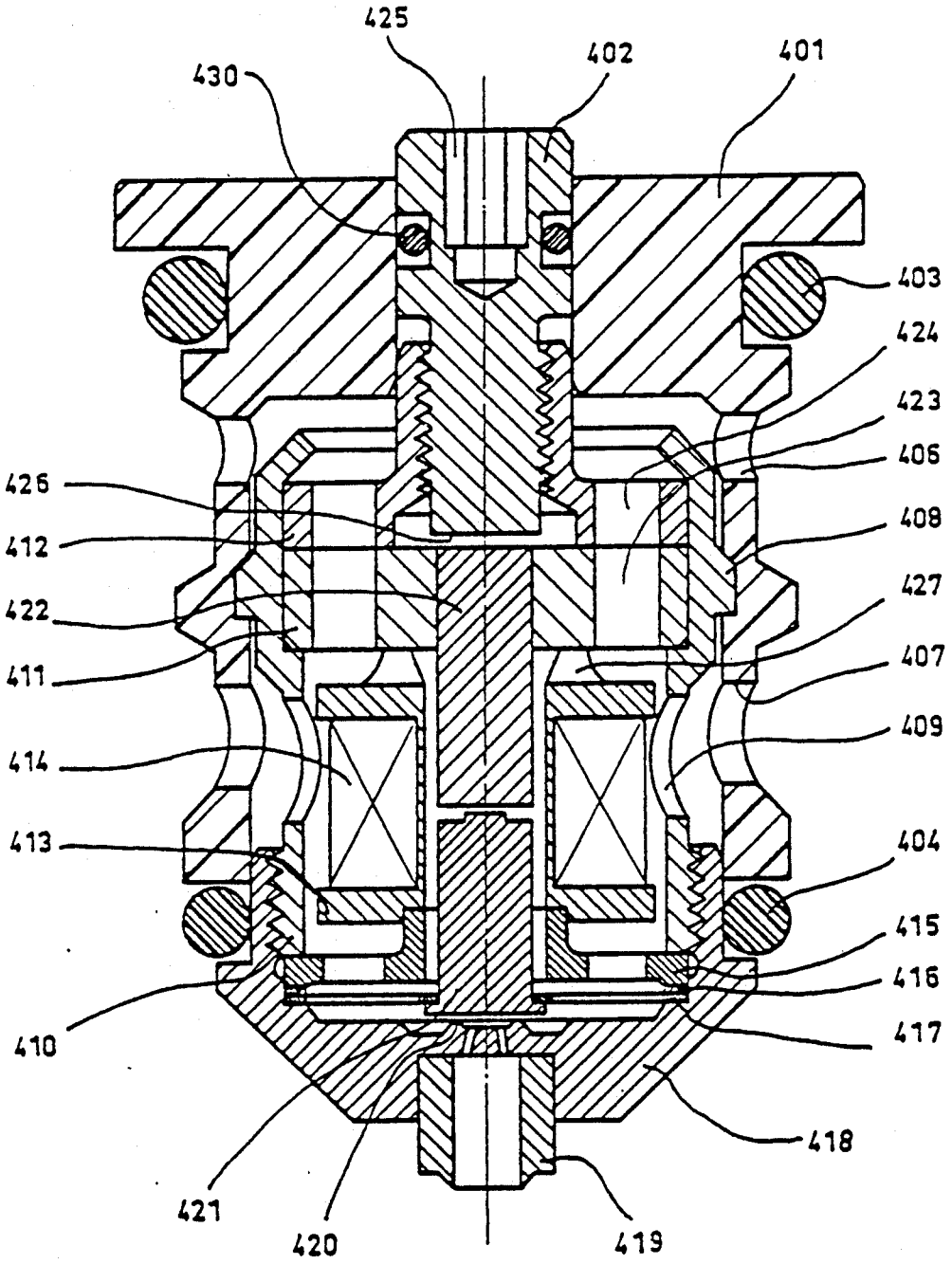

FIG. 4 provides a further example of a composite valve, featuring an injector valve which is similar to that described in FIG. 1. A distinguishing feature is that the lower closure plug of the injector valve is thread-mounted on the outside of the valve housing, while in the example according to FIG. 1, the plug is threaded on the inside of the valve housing. Threading on the outside provides the advantage that a gasket in the housing cover region can be omitted. In addition, it allows for the use of a larger diameter diaphragm valve, allowing for less costly production of the diaphragm valve. The diaphragm valve is inserted into valve carrier 401. Valve carrier 401 contains a groove in which the injector valve is clamp-mounted by means of housing collar 408. The contact pins are not shown. The always necessary fuel filter is installed either inside or outside on valve carrier 401 in the region of the feed nozzle openings. The magnetic circuit of the injector valve consists of armature 421, magnet pole 422, calibration screw 402, flange 412, valve housing 410, and side-pole 415. Magnet pole 422 is pressure-fitted into non-magnetizable flange 411. Calibration gap 426 is located between magnet pole 422 and calibration screw 402. By turning calibration screw 402, the magnetic resistivity of this gap can be altered. This provides a means for dynamically calibrating the valve. Calibration screw 402 contains gasket 430 and internal six point socket 425. Flanges 411 and 412 are clamped in housing 410 by beading. Housing 410 is threaded at the bottom, allowing the screw mounting of lower housing cover 418. Between housing 410 and the lower housing cover, the following elements are clamp-mounted: side-pole 415, diaphragm spring 417, and gauge ring 416. Gauge ring 416 serves to set the armature stroke. It is suitable to provide a gauge ring consisting of material which is relatively easy to deform. For example, such a gauge ring may be made of lead. Given a deformable gauge ring, the fine calibration of the armature stroke can be achieved by squeezing of the gauge ring. The necessary force results from turning lower housing cover 418. Armature 421 is radially guided by diaphragm spring 417. The latter is perforated. Coil core 413 is slipped onto side-pole 415 and fits at the top against flange 411 by means of several lips 427. Magnet coil 414 is wound onto coil core 413. The valve is continuously perfused by fuel, in line with state of the art conditions. Housing 410 and valve carrier 401 are provided with drilled side openings 409 and 407 which serve as entry ports for the fuel. Inside the housing the fuel passes through flange holes 423 and 424 into the upper section of valve carrier 401. By means of passage 406 the fuel passes to the recycle loop. Coil core 413 and magnet coil 414 are completely surrounded by the fuel. Valve seat 420 and the nozzle openings are machined into lower housing cover 418. Cover 418 also contains pressure fitted spray diffuser 419. The valve is sealed with outer gaskets 403 and 404 in a mounting port which is not shown. The small overall dimensions of the valve allow for the use of outer gaskets with large cross-sections which considerably eases the mounting of the valve.

In conclusion, it should be mentioned that the injector valve can also be provided with a diaphragm spring featuring soft spring characteristics. This is advantageous from a production point of view, allowing for larger tolerances with respect to spring positioning. However, it is to be noted that soft spring characteristics are always connected with poorer effectiveness in electrical energy conversion. In addition, it is also possible to equip the injector valve with a different valve seat than the flat-mounted seat shown in the drawing. For instance, the armature may also feature a ball-shaped or cone-shaped obturator at its lower end. However, such seat designs always require greater manufacturing precision, and hydraulically parallel guidance is thus not possible with reasonable production costs. It is to be noted that the stated dimensions and procedures of connecting the elements are considered suitable, but only serve as examples. The calibration procedure disclosed here can also be used to advantage with existing state of the art valve types.

Other suitable design variants of the injector valve according to this invention can be deduced from the claims.

I claim:

1. An electromagnetic fuel injector comprising body structure having a main longitudinal axis, a fuel inlet port, a fuel outlet port, a fuel path extending through said body structure between said fuel inlet and said fuel outlet ports, a valve seat circumscribing said fuel path, a closure surface that coacts with said valve seat to open and close said fuel path, an armature that is biased on said body structure by a spring to cause said closure surface to seat against said valve seat and block flow through said fuel path, and a solenoid mounted on said body structure and comprising a coil that is coaxial with said axis, that contains a stator which passes axially partially through said coil to terminate in a pole disposed within said coil and facing said armature, and that when energized causes said armature to be attracted toward said pole and to unseat from said valve seat so that fuel can flow through said fuel path, characterized in that said armature comprises a main body having a first portion disposed within said coil and a second portion disposed without said coil, said spring is a spring disc having an outer peripheral margin held on said body structure, said spring disc has through-aperture means located centrally therein, said second portion of said armature passes through said through-aperture means to form a joint for joining said armature with a central region of said spring disc, and said spring disc is disposed in said fuel path and comprises further through-aperture means that allows for fuel to flow through said spring disc, said body structure comprises a first part containing said valve seat and a second part, said two parts are coaxially threaded together about said axis so that the axial position of said first part on said second part can be adjusted, the peripheral margin of said spring disc bears directly against a peripheral surface portion of said first part, and resilient means are provided between said spring disc and said second part to allow for the adjustment of said first part on said second part.

2. A fuel injector as set forth in claim 1 characterized further in that said closure surface is on said spring disc.

3. A fuel injector as set forth in claim 1 characterized further in that said closure surface is on said second portion of said armature.

4. A fuel injector as set forth in claim 1 characterized further in that said resilient means is disposed to bear directly against said spring disc.

5. A fuel injector as set forth in claim 1 characterized further in that said resilient means is disposed to bear against said spring disc through a thrust ring.

6. A fuel injector as set forth in claim 1 characterized further in that said first portion of said armature main body comprises a face confronting said pole and hydraulic dampening means are provided between said face and said pole.

7. A fuel injector as set forth in claim 1 characterized further in that said hydraulic dampening means comprises said pole having a flat surface transverse to said axis and said face having a central protrusion that is circumferentially surrounded by an annular gap.

8. An electromagnetic fuel injector comprising body structure having a main longitudinal axis, a fuel inlet port, a fuel outlet port, a fuel path extending through said body structure between said fuel inlet and said fuel outlet ports, a valve seat circumscribing said fuel path, a closure surface that coacts with said valve seat to open and close said fuel path, an armature that is biased on said body structure by a spring to cause said closure surface to seat against said valve seat and block flow through said fuel path, and a solenoid that is mounted on said body structure and that when energized causes said armature to unseat from said valve seat so that fuel can flow through said fuel path, characterized in that said spring is a spring disc having an outer peripheral margin held on said body structure, there exists a joint for joining said armature with a central region of said spring disc, said spring disc is disposed in said fuel path and comprises further through-aperture means that allows for fuel to flow through said spring disc, said body structure comprises a first part containing said valve seat and a second part, said two parts are coaxially related such that the axial position of said first part on said second part can be adjusted, the peripheral margin of said spring disc bears directly against a peripheral surface portion of said first part, and resilient means are provided between said spring disc and said second part to allow for the adjustment of said first part on said second part.

9. A fuel injector as set forth in claim 8 characterized further in that said resilient means is disposed to bear directly against said spring disc.

10. A fuel injector as set forth in claim 8 characterized further in that said resilient means is disposed to bear against said spring disc through a thrust ring.

11. A fuel injector as set forth in claim 8 characterized further in that said first part is adjustable on said second part via a threaded connection between them.

* * * * *